US006761645B1

(12) United States Patent
Weber

(10) Patent No.: US 6,761,645 B1
(45) Date of Patent: Jul. 13, 2004

(54) GOLF BALL LUBRICANT

(76) Inventor: Lawrence J. Weber, 3923 S. Chase Way, Denver, CO (US) 80235

( * ) Notice: Subject to any disclaimer, the term of this patent is extended or adjusted under 35 U.S.C. 154(b) by 0 days.

(21) Appl. No.: 09/586,074

(22) Filed: Jun. 2, 2000

Related U.S. Application Data

(60) Provisional application No. 60/183,646, filed on Feb. 18, 2000.

(51) Int. Cl.[7] ..... A63B 37/00

(52) U.S. Cl. ..... 473/351; 508/154

(58) Field of Search ..... 473/378, 371, 473/377, 351, 594; 508/154

(56) References Cited

U.S. PATENT DOCUMENTS 5,045,360 A * 9/1991 Kosal et al. ..... 427/387
5,120,358 A * 6/1992 Pippett ..... 106/31.01
5,425,989 A * 6/1995 Ogawa et al. ..... 428/333
5,827,133 A * 10/1998 Chang ..... 473/354
5,836,827 A * 11/1998 Ogawa et al. ..... 473/125
5,885,171 A * 3/1999 Sharpe ..... 473/330
5,935,913 A * 8/1999 Nalesnik et al. ..... 508/255
6,046,142 A * 4/2000 Zilonis et al. ..... 508/154
6,217,464 B1 * 4/2001 Chang ..... 473/378

* cited by examiner

*Primary Examiner*—Raeann Gorden
(74) *Attorney, Agent, or Firm*—John E. Reilly

(57) ABSTRACT

A coating composition for a golf ball is comprised of a slippery, transparent or white, non-sticky lubricant film, and a method for applying same to a golf ball comprises the steps of applying the lubricant to an external surface of the golf ball prior to striking the ball with a golf club, and applying the coating uniformly to the external surface of the golf ball and to a sufficient degree as to reduce the friction between said external surface and the atmosphere or ground when propelled through the atmosphere or along the ground, respectively.

9 Claims, No Drawings

GOLF BALL LUBRICANT

CROSS-REFERENCE TO RELATED APPLICATION

This application claims the benefit of Provisional Application Serial No. 60/183,646 filed Feb. 18, 2000, by Lawrence J. Weber.

BACKGROUND AND FILED OF INVENTION

This invention relates to a coating material for golf balls and to a method of applying same; and more particularly relates to a novel and improved method and composition for increasing the distance of travel of propelled golf balls, in carry and roll.

Perhaps no more time and attention is devoted to any facet of sport than to improving golf club equipment to enable a golfer to hit the ball farther and straighter. Millions of dollars are spent each year to improve or modify the swing characteristics of a golf club whether by way of changing its composition, size, shaft length or stiffness. Similarly, golf balls are constantly being modified in terms of composition, number of dimples, impact resistance, etc. to somehow increase the distance or carry of the ball as well as minimize any tendency of the ball to hook or slice.

Previously, efforts have been made to alter the coefficient of friction of the golf club face so as to control its effect on the flight of the ball whether in terms of imparting more or less side spin or back spin. See U.S. Pat. No. 5,885,171. To the best of my knowledge however, no one has devised a simple effective method or means for lubricating the surface of a golf ball so as to improve its flight characteristics by increasing its distance or carry in response to a given impact or striking force, by reduction of the dynamic friction between the ball and the air. In this relation, it is desirable to enhance the ability of the ball to roll for greater distances along the ground and to minimize any tendency to hook or slice; and still further to make the ball far less susceptible to foreign elements, such as, the wind. Further, it is desirable to provide a composition and method of coating a golf ball which can be applied to the ball without applying to and affecting the golfer's hand in retaining a secure grip on the golf club when striking the ball or, in other words, will not be significantly transferred or removed from the surface of the ball when the ball is later handled in teeing the ball or in handling the ball on the green.

SUMMARY OF THE INVENTION

It is therefore an object of the present invention to provide for a novel and improved method and composition for treating golf balls to improve their flight and roll characteristics.

It is another object of the present invention to provide for a novel and improved method and composition for coating the external surface of a standard golf ball to reduce the dynamic friction between the surface of the ball and the air and improve its flight characteristics; and specifically wherein the distance or carry of the ball when struck is increased and where the ball impacts the ground dynamically, the reduced coefficient of friction of the surface of the ball results in increased distance or roll.

It is a further object of the present invention to provide for a novel and improved lubricant for coating standard golf balls during the course of play and wherein the lubricant can be applied to the ball in such a way as not to be significantly transferred to the golfer's hands or grips of the golf club.

It is a further object of the present invention to provide for a novel and improved liquid film lubricant composition and method of applying same which is highly effective either alone or in combination with other ingredients in improving the flight characteristics of the golf ball.

In accordance with the present invention, a lubricant coating composition for golf balls is comprised of a slippery, film, transparent, white or other color matched to the golf ball, lubricant which when applied in a liquid state to an external surface of the golf ball prior to striking the golf ball with a golf club will reduce the coefficient of friction of the external surface of the golf ball when propelled through the atmosphere and in rolling along the ground. Preferably, the golf ball lubricant is a silicone or siloxane polymer fluid, paste or gel. A preferred lubricant is one containing polydimethylsiloxane alone; or, in the case of fluid spray application, combined with sufficient highly vaporous solvent(s), preferably heptane, to act as a diluent and facilitate spray application by pump spray or by aerosol spray and are one(s) that will rapidly vaporize after the lubricant coating mixture is applied to the external surface of a golf ball. The golf ball lubricant can also be other silicone or siloxane polymers that are slippery or non-sticky, transparent or white fluids, pastes, gels such as polymethylphenylsiloxane, polyethylphenylsiloxane, polymethylcyclo-hexylsiloxane, polymethylbutylsiloxane, polymethyl-ethylsiloxane, polybutylphenlsiloxane, polydiphenyl-siloxane, polymethylhexylsiloxane, chlorinated aromatic siloxanes, such as, chloromethylaromatic groups, chloropropylmethylsiloxane-dimethylsiloxane, carbonyl terminated siloxanes, amino silicone emulsions and epoxy functional siloxanes.

The above-described polymers may also be combined with polytetrafluoroethylene (PTFE).

The lubricant can also be polytetra-fluoroethylene (PTFE), or an emulsion, or with a carrier, or in combination with other compounds and solvents, that becomes a film lubricant.

Further, in accordance with the present invention, a method for enhancing the flight characteristics of a golf ball comprises the steps of applying a coating of a slippery, transparent or white, non-sticky lubricant to an external surface of the golf ball prior to striking the golf ball with a golf club, and applying the coating uniformly to the external surface of the golf ball and to a sufficient degree as to reduce the coefficient of friction of the external surface of the golf ball when propelled through the atmosphere, and when in dynamic contact with the ground (grass). Preferably, the coating is applied by combining the lubricant with a highly evaporative solvent, preferably heptane, or other transparent highly evaporative carrier which will enable the lubricant to be sprayed from a spray dispenser directly onto the surface of the ball. In this way, the golf ball may be sprayed periodically throughout each round of golf to optimize its flight characteristics and specifically to carry for greater distances in the air as well as to produce increased roll along the ground.

The above and other objects, advantages and features of the present invention will become more readily appreciated and understood from a consideration of the following detailed description of preferred and modified forms of the present invention.

DETAILED DESCRIPTION OF PREFERRED EMBODIMENT

The construction and make-up of a golf ball are fairly standard, notwithstanding continuous attempts to modify them to increase their distance or carry in response to being struck by a golf club. Whether made of natural or synthetic materials, the cover of a golf ball is substantially if not completely non-porous or water-resistant with dimples and paint on its external surface to impart certain aerodynamic qualities to the ball. In fact, efforts have been made to regulate dimple size and spacing to modify the aerodynamics of the ball while remaining within certain restrictions imposed by the United States Golf Association (USGA) and Royal and Ancient Golf Club of St. Andrews (R&A) on the manufacture and construction of a ball.

In accordance with the present invention, it has been found that application of certain lubricants to the external surface of the golf ball will reduce its coefficient of friction. As a result, the flight characteristics of the golf ball can be enhanced to increase its distance or carry as well as the distance of roll along the ground once it lands. Furthermore, a reduction in the coefficient of friction reduces the effect of spin imparted to the ball and therefore minimizes the tendency to slice or hook.

A preferred lubricant composition is one that can be directly applied to the ball so as to form a uniform coating of lubricant film on the ball and reduce the coefficient of friction or drag of the entire ball surface when propelled through the air. To this end, it is also preferable that the lubricant be combined with a carrier which will enable it to be applied by spraying from a spray dispenser directly onto the ball. The carrier shall be transparent, colorless and highly evaporative so as to rapidly evaporate from the lubricant coating after applying to the golf ball. The lubricants of the present invention are also characterized by being non-sticky and are not soluble in water. Another desirable characteristic of the lubricant is that it be transparent, white or otherwise color-matched so as not to alter the appearance of the ball once applied. Another obvious requisite of the lubricant composition is that it not undergo any reaction with the surface of the golf ball but, when applied, will adhere to the surface without undergoing any reaction with it.

A preferred lubricant composition is a polydimethylsiloxane combined with a highly evaporative solvent, preferably heptane, which will facilitate application by spraying directly onto the golf ball using a spray dispenser and evaporate rapidly from the lubricant mixture after coating the ball. Typical of the polydimethylsiloxane polymers are those sold by Dow Corning under the trademark "DOW CORNING 200®" and with varying viscosities as follows:

| As Supplied | 200 Fluid 50 cSt | 200 Fluid 100 cSt | 200 Fluid 500 cSt | 200 Fluid 1000 cSt |
|---|---|---|---|---|
| Appearance | <=------crystal clear liquid free from suspended matter and sediment----=> | | | |
| Specific Gravity @25° C. | 0.960 | 0.964 | 0.969 | 0.970 |
| Color, AFHA | 5 | 5 | 5 | 5 |
| Surface Tension @25° C., dynes/cm | 20.8 | 20.9 | 21.1 | 21.2 |
| Viscosity Temperature Coefficient | 0.59 | 0.60 | 0.60 | 0.61 |
| Solubility in Typical Solvents: | | | | |
| Aromatic Solvents | High | High | High | High |
| Dry Alcohols | Poor | Poor | Poor | Poor |
| Water | Poor | Poor | Poor | Poor |

Polydimethylsiloxane polymers are merely one of a great many polymers in the hydrogen-containing family and it will be evident that numerous other siloxane compositions having the properties enumerated above would also qualify for use as a satisfactory lubricant for a golf ball. Other representative siloxane compounds are various combinations of the radicals methyl, dimethyl, ethyl, phenyl, tetraphenyl, butyl, hexyl, cyclohexyl, chloro and propyl with siloxane. The family of such lubricant compounds could be described as combinations of one or more radicals of methyl, dimethyl, ethyl, phenyl, diphenyl, tetraphenyl, butyl, hexyl, cyclohexyl, chloro and propyl with siloxane.

In addition, the polydimethylsiloxane may be combined with other lubricants, such as, for example, polytetrafluoroethylenes and a suitable carrier to act as an effective lubricant for golf balls. A typical formulation is as follows:

| Components | Percentage by Weight |
|---|---|
| Polytetrafluoroethylene | 50% |
| Silicone Oil Dow Corning 200, 50 cSt. | 50% |

The polydimethylsiloxane may be suitably combined with other ingredients including but not limited to chlorotrifluoroethylene, silica (amorphous treated), lithium oxide, chloroproplymethylsiloxane and carbooxypropl silicones.

Another siloxane lubricant that is suitable for use in accordance with the present invention is the V-728 lubricant manufactured and sold by Amerex Corporation and made up of the following ingredients:

| Chemical Name | Percentage by Weight |
|---|---|
| Dimethylpolysiloxane | 89–94% |
| Silica, Amorphous Treated | 4–7% |

In addition to the siloxane polymers, numerous other film polymers may be utilized under the present invention. Thus TEFLON®, which is a trademark for a solid, chemically inert polymer of tetrafluoroethylene and is extensively used for non-stick cookware, can be formulated to be utilized.

Although the film lubricants hereinbefore described are the compositions of choice for application to a golf ball, it will be apparent that other lubricants may be equally effective in reducing the coefficient of friction between the external surface of the golf ball and the atmosphere and the ground. The film lubricants combined with vaporous solvents dry quickly and therefore can be applied almost immediately prior to placing the ball in play, and the lubricated ball can be carefully handled by the golfer without making the hands slippery. The lubricant itself can be a liquid, paste or gel and can be applied by spraying, wiped or brushed onto the golf ball. Spraying is preferred in that the ball can be held in a towel and the lubricant can be stored in any suitable type of spray bottle, pressurized aerosol spray can, or a squeeze bottle/valve bottle with a sponge or brush-type applicator. As an alternative to spraying, a cloth impregnated with the lubricant may have a backing which is impervious to a lubricant so that the golfer comes into contact only with the backing in handling the ball and applying the lubricant. Most desirably, the applicator or dispenser is of a size that can be carried by the golfer so that it can be applied frequently during play to maintain optimum surface-slip characteristics of the ball. Typically, the golfer would apply to the ball in the process of cleaning the ball after each hole or several holes of play, or may take the place of cleaning the ball by applying to the surface and wiping clean.

The lubricant shall dry to a very thin film coating. The viscosity and density of the lubricant and the application method shall be such that the dried coating shall preferably be 5 to 13 microns thick, with a minimum/maximum thickness of 3 to 50 microns.

I claim:

1. A method for enhancing the flight characteristics of a golf ball comprising the steps of:

(a) providing a coating of a slippery, transparent or color-matched to the ball, non-sticky lubricant as a liquid, paste or gel and wherein said lubricant is a siloxane polymer in a carrier, and wherein said siloxane polymer is polydimethylsiloxane; and (b) repeatedly applying said coating uniformly to the external surface of said golf ball at frequent intervals during each round that said golf ball is in play and to a sufficient degree as to reduce the friction between said external surface and the atmosphere or ground when propelled through the atmosphere or along the ground, respectively.

2. The method of according to claim 1 wherein said carrier is a highly evaporative solvent, preferably heptane.

3. The method according to claim 1 wherein said coating is applied by spraying onto said external surface of said golf ball from a spray dispenser.

4. The combination consisting of a golf ball adapted to be propelled through the atmosphere when struck by a golf club, a lubricant composition selected from the group consisting of siloxane polymers, said composition containing a carrier but containing no curing or hardening agent, and dispensing means for repeatedly applying said lubricant composition as a liquid, paste or gel to an external surface of said golf ball during each round that said golf ball is in play and to a sufficient degree as to reduce the friction between said external surface and the atmosphere or ground when propelled through the atmosphere or along the ground, respectively.

5. The combination according to claim 4, said lubricant composition being a liquid, paste or gel and which is slippery and non-sticky when applied to said external surface.

6. The combination according to claim 4 wherein said composition is transparent.

7. The combination according to claim 4 wherein said composition is color-matched to said golf ball.

8. The combination according to claim 4 wherein said composition is selected from the group consisting of polymethylphenylsiloxane, polyethylphenylsiloxane, polymethylcyclo-hexylsiloxane, polymethylethylsiloxane, polymethylbutylsiloxane, polybutylphenylsiloxane, polydiphenylsiloxane, polymethylhexylsiloxane, chlorinated aromatic siloxanes, such as chloromethylaromatic groups, chloropropylmethylsiloxane-dimethylsiloxane, carbonyl terminated siloxanes, amino siloxane, and epoxy functional siloxanes.

9. A method for enhancing the flight characteristics of a golf ball comprising the steps of:

(a) providing a coating of a slippery, transparent or white, non-sticky lubricant as a liquid, paste or gel and wherein said lubricant is a siloxane polymer in a carrier;

(b) combining the polytetrafluoroethylene with said siloxane polymer and said carrier to form said coating; and (c) repeatedly applying said coating uniformly to the external surface of said golf ball at frequent intervals during each round that said golf ball is in play and to a sufficient degree as to reduce the friction between said external surface and the atmosphere or ground when propelled through the atmosphere or along the ground, respectively.

* * * * *